United States Patent [19]

Stanko

[11] Patent Number: 4,970,038

[45] Date of Patent: Nov. 13, 1990

[54] PROCESS OF PREPARING POLYESTER YARN

[75] Inventor: Wayne S. Stanko, Asheville, N.C.

[73] Assignee: BASF Corporation, Williamsburg, Va.

[21] Appl. No.: 277,371

[22] Filed: Nov. 29, 1988

[51] Int. Cl.[5] ..... D01D 5/16; D01D 10/02; D01F 6/62

[52] U.S. Cl. ..... 264/130; 264/210.7; 264/210.8; 264/211.15; 264/211.17; 264/235.6; 264/290.5; 264/346

[58] Field of Search ..... 264/290.5, 210.8, 346, 264/345, 235, 235.6, 211.15, 211.17, 130, 210.7

[56] References Cited

U.S. PATENT DOCUMENTS

| | | | |
|---|---|---|---|
| 3,452,132 | 6/1969 | Pitzl | 264/210.8 |
| 3,739,056 | 6/1973 | Evans et al. | 264/290.5 |
| 4,049,763 | 9/1977 | Mineo et al. | 264/210.8 |
| 4,195,051 | 3/1980 | Frankfort et al. | 264/210.2 |
| 4,195,052 | 3/1980 | Davis et al. | 264/235 |
| 4,251,481 | 2/1981 | Hamlyn | 264/290.5 |
| 4,374,797 | 2/1983 | Koshinek et al. | 264/210.8 |

FOREIGN PATENT DOCUMENTS

| | | | |
|---|---|---|---|
| 59-163415 | 9/1984 | Japan | 264/210.8 |
| 1115143 | 5/1968 | United Kingdom | 264/290.5 |

*Primary Examiner*—Hubert C. Lorin

[57] ABSTRACT

A yarn comprising polyester fibers having an improved balance of properties (tenacity and boiling water shrinkage) is produced within predetermined limits. The polyester yarn is prepared by cold drawing a partially oriented feeder yarn, partially annealing the drawn yarn, and subsequently annealing the partially annealed cold drawn yarn at controlled tensions.

15 Claims, 2 Drawing Sheets

PROCESS OF PREPARING POLYESTER YARN

BACKGROUND OF THE INVENTION

This invention relates to yarn containing polyester fibers having an improved balance of properties including tenacity and boiling water shrinkage, which find particular application in textile uses.

Polyester fibers have been prepared for commercial use for more than thirty years, and are produced in large quantities. Most commercial polyester comprises linear terephthalate polyesters.

The term "fiber" as used herein includes fibers of extreme or indefinite length (i.e., filaments) and fibers of short length (i.e., staple). The term "yarn", as used herein, means a continuous strand of fibers.

Because fibers produced from polyester have a number of outstanding characteristics including excellent dimensional stability and sturdiness, a high degree of crease resistance, good bulk elasticity, and warm handle, the fibers have found a wide variety of applications, especially in the textile field.

Many textile applications require yarns containing polyester fibers having predetermined limits with respect to tenacity and boiling water shrinkage. Some procedures utilized to produce polyester fibers result in fibers having an acceptable (low) boiling water shrinkage, but a tenacity which is too low. Conversely, other procedures utilized to produce polyester fibers result in fibers having an acceptable tenacity, but an unacceptable boiling water shrinkage Even within the acceptable tenacity and boiling water shrinkage limitations, certain variations in boiling water shrinkage and tenacity of the fibers are required for certain textile applications. Still further, some processing applications require that the fibers have sufficient elongation so that they can be further processed.

For instance, it is sometimes desirable to produce fibers which have a lower tenacity which, during further processing, can be broken in order to provide a yarn containing polyester fibers having a "good feel". Furthermore, in many textile applications where high tenacity fibers are not of critical importance, a low boiling water shrinkage is sometimes desired.

Thus, a need exists for a process which facilitates the uniform preparation of a yarn comprising polyester fibers within predetermined limits of fiber properties including tenacity and boiling water shrinkage.

SUMMARY OF THE INVENTION

It has been surprisingly discovered that a polyester yarn comprising fibers having predetermined limits with respect to tenacity and boiling water shrinkage can be prepared from a partially oriented polyester feeder yarn having a birefringence ($\Delta n$) of at least 0.0175 by drawing the feeder yarn at ambient temperature (20°–25° ) and controlled draw ratios, partially annealing the drawn yarn at controlled temperatures, and subsequently further annealing the partially annealed yarn at controlled temperatures and tensions, i.e., from about 0.01 to about 50 grams. The yarn produced by the present invention has a higher tenacity when the partially annealed yarn is annealed at higher tensions and a low boiling water shrinkage when the partially annealed yarn is annealed at lower tensions. The process finds particular application in producing yarns containing polyester fibers having a boiling water shrinkage in the range of from about 2 to about 10 percent and a tenacity in the range of from about 4.5 to about 7.0 g/denier.

DETAILED DESCRIPTION OF THE PREFERRED EMBODIMENTS

Figure 1:
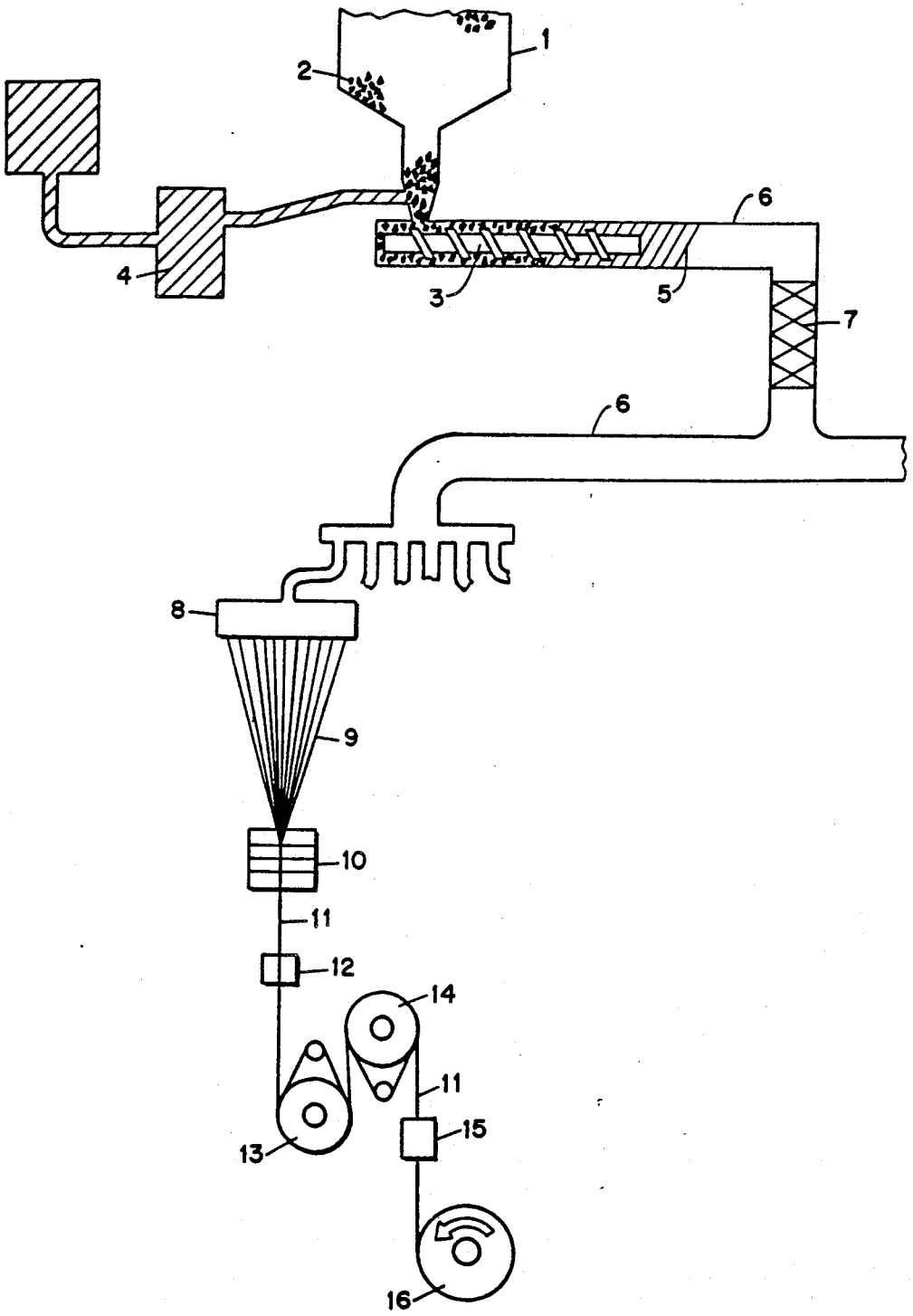
FIG. 1 is a partial schematic of the apparatus and process suitable for preparing the feeder yarn of the invention.

The preferred polyesters include linear terephthalate polyesters (PET), i.e., polyesters of a glycol containing from 2 to 20 carbon atoms and a dicarboxylic acid component comprising at least about 75% terephthalic acid. The remainder, if any, of the dicarboxylic acid component may be any suitable dicarboxylic acid such as sebacic acid, adipic acid, isophthalic acid, sulfonyl-4,4-dibenzoic acid, or 2,8-dibenzofurandicarboxylic acid. Examples of linear terephthalate polyesters which may be employed include poly(ethylene terephthalate), poly(butylene terephthalate), poly(ethylene terephthalate/5-chloroisophthalate) (85/15), poly(ethylene terephthalate/5-[sodium sulfo] isophthalate)(97/3), poly(cyclohexane-1,4-dimethylene terephthalate/hexahydroterephthalate)(75/25).

The preferred polyester is poly(ethylene terephthalate), which includes a linear polyester in which at least about 85% of the recurring structural units are ethylene terephthalate units of the following formula:

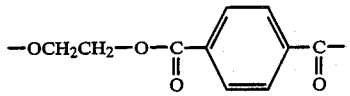

More preferably, the polyester is a linear polyester containing at least ninety percent (90%) recurring structural units of ethylene terephthalate. In a particularly preferred embodiment of the process, the polyester is substantially all poly(ethylene terephthalate). Up to 10 mol percent (10%) of other copolymerizable ester units other than poly(ethylene terephthalate) can also be present.

The polyester yarn having predetermined limits with respect to boiling water shrinkage and tenacity is produced by the following procedure:

(a) draw a feeder yarn having a birefringence ($\Delta n$) of at least 0.0175 at ambient temperature, i.e., in the range of from about 20° to about 25° C., and a draw ratio in the range of from 1.75 to about 2.60;

(b) partially anneal the drawn feeder yarn of step (a) at a temperature in the range of from about 70° to about 110° C.; and, (c) anneal the partially annealed feeder yarn of step (b) at a temperature in the range of from about 110° to about 60° C., and at a tension in the range of from about 0.001 to about 50 grams.

Preferably, the drawing of the feeder yarn of step (a) is carried out at a draw ratio in the range of from 2.00 to about 2.50.

The drawn feeder yarn of step (b) is preferably partially annealed at a temperature in the range of from about 90° to about 110° .

With respect to the annealing of the partially annealed yarn, when the annealing is carried out under high tension, about 20 to about 50 grams, the resulting yarn exhibits higher tenacity, e.g., 6.5 g/denier, and a higher boiling water shrinkage, e.g., 5 to 10%. When the annealing is carried out at low tension, 0.001 to about 10 grams, the yarn exhibits lower tenacity, e.g., 4.5 grams/denier, and lower boiling water shrinkage, e.g., 2%.

To prepare a polyester yarn having higher tenacity, the process is preferably carried out using the following steps:

(a) draw a feeder yarn having a birefringence (Δn) of at least 0.0175 at ambient temperature, i.e., in the range of from about 20° to about 25° C., and at a draw ratio in the range of from 2.20 to about 2.55;

(b) partially anneal the drawn feeder yarn of step (a) at a temperature in the range of from about 90° to about 110° C.; and, (c) further anneal the partially annealed feeder yarn of step (b) at a temperature in the range of from about 130° to about 160° C., and at a tension in the range of from about 20 to about 50 grams per denier.

The polyester yarns produced by this procedure will generally have a tenacity in the range of from about 6.0 to about 7.5 grams per denier, a boiling water shrinkage in the range of from about 5% to about 10%, and an elongation in the range of from about 12 to about 15%.

To prepare a polyester yarn having a lower boiling water shrinkage, the process is preferably carried out using the following steps:

(a) draw a feeder yarn having a birefringence (Δn) of at least 0.0175 at ambient temperature, i.e., in the range of from about 20° to about 25° C., and a draw ratio in the range of from 1.95 to about 2.05;

(b) partially anneal the drawn feeder yarn of step (a) at a temperature in the range of from about 80° to about 100° C.; and, (c) anneal the partially annealed feeder yarn of step (b) at a temperature in the range of from about 140° to about 160° C., and at a tension in the range of from about 0.001 to about 5 grams per denier.

The polyester yarn produced by this procedure will generally have a boiling water shrinkage in the range of from about 2% to 3%, a tenacity in the range of from about 4.5 to about 5.5 grams per denier, and an elongation in the range of from about 25% to about 35%.

Any suitable procedure can be utilized to prepare the partially oriented feeder yarn. A preferred procedure comprises the following steps:

(a) extrude molten poly(ethylene terephthalate having an intrinsic viscosity in the range of from about 0.40 to about 0.8, and preferably about 0.60 to about 0.70, through a spinneret to form one or more fibers;

(b) quench said fibers, preferably to a temperature not exceeding 40° C. higher than the glass transition of the poly(ethylene terephthalate);

(c) optionally, apply to said fibers of step (b) by lubricating finish in an amount in the range of 0.1 to about 1.0 weight percent based on the weight of the yarn; and, (d) take up said quenched fibers of step (b) or (c) at a take-up speed sufficient to partially orient the fibers in an amount sufficient to achieve a birefringence (Δn) in said fibers of at least 0.0175, and preferably from about 0.020 to about 0.037, which generally is a speed in the range of from about 2,200 meters/minute to about 3,000 meters/minute and, more preferably, 2,700 meters/minute to 2,800 meters/minute.

Various characteristics and measurements are utilized throughout the application. These characteristics and measurements are grouped here for convenience, although most are standard.

The term "boiling water shrinkage" is defined as "percent decrease in length of material when exposed to elevated temperatures for a period of time and under 0.05 g.p.d. tension". In the present invention, the percent thermal shrinkage is measured in a boiling water bath of 100° C. for a period of 30 minutes. The shrinkage of the fiber is determined in accordance with the following formula:

$$\text{Shrinkage} = \frac{L_1 - L_2}{L_1} \times 100$$

wherein $L_1$ is original length of fiber; and $L_2$ is length of fiber after treatment.

Within the specification and claims, the intrinsic viscosity of the polyester melt is given as a measure for the mean molecular weight, which is determined by standard procedures wherein the concentration of the measuring solution amounts to 0.5 g./100 ml., the solvent is a 60 percent by weight phenol/40 percent by weight tetrachloroethane mixture, and the measuring temperature is 25° C.

The tenacity or breaking strength in grams per denier (UTS) is defined by ASTM Standards, Part 24, American Society for Testing and Materials, 1916 Race Street, Philadelphia, PA, page 33 (1965) as "the maximum resultant internal force that resists rupture in a tension test", or "breaking load or force, expressed in units of weight required to break or rupture a specimen in a tensile test made according to specified standard procedure". Elongation is the elongation at the time of break.

Birefringence (Δn) is obtained in the following manner:

Sodium D rays (wavelength 589 millimicrons) are used as a light source, and the filaments are disposed in a diagonal position. The birefringence (Δn) of the specimen is computed from the following equation:

$$n = \frac{n\lambda + r}{\alpha}$$

when n is the interference fringe due to the degree of orientation of the polymer molecular chain; r is the retardation obtained by measuring the orientation not developing into the interference fringe by means of a Berek's compensator; α is the diameter of the filament; and λ is the wavelength of the sodium D rays.

Referring to FIG. 1, a method of preparing a partially oriented feeder yarn having a birefringence (Δn) of at least 0.0175 is illustrated. The method comprises first supplying a chip hopper 1 with chips comprising polyester 2. The hopper 1 in turn supplies an extruder 3 with the chips 2. An additive pump 4 is also illustrated whereby various liquid additives such as pigments or heat stabilizers can be added, if desired, to the chip stream which is entering the extruder 3. Once the chips exit the extruder as a molten stream 5, the stream is pumped through a conduit 6 which contains a plurality of static mixers 7. Once through the static mixers 7, the mix stream enters the spinneret 8 and is extruded into a plurality of molten streams 9 which are solidified in a quench chamber 10. The quench chamber is generally an elongated chimney of conventional length, preferably 60 to 80 inches, which has a gaseous atmosphere below the glass transition temperature of the molten polyester. The solidified fibers 11 next pass over an applicator 12 whereby the fibers are lubricated. Lubricants suitable for such use are known to those skilled in the art and include mineral oil, butyl stearate, alkoxylated alcohols, and phosphates or cationic antistatic compositions. The fibers next travel around a first (upstream) powered godet 13 and then around a second (downstream) godet 14, following which the yarn 11 is interlaced by an interlacer 15. Lastly, the filaments are wound onto a bobbin 16. The filaments at this point are generally referred to as feeder yarn.

The speed at which the spun fibers are wound must be in the range of from about 2,000 to about 3,000 meters per minute and, preferably, about 2,750 meters per minute.

Figure 2:
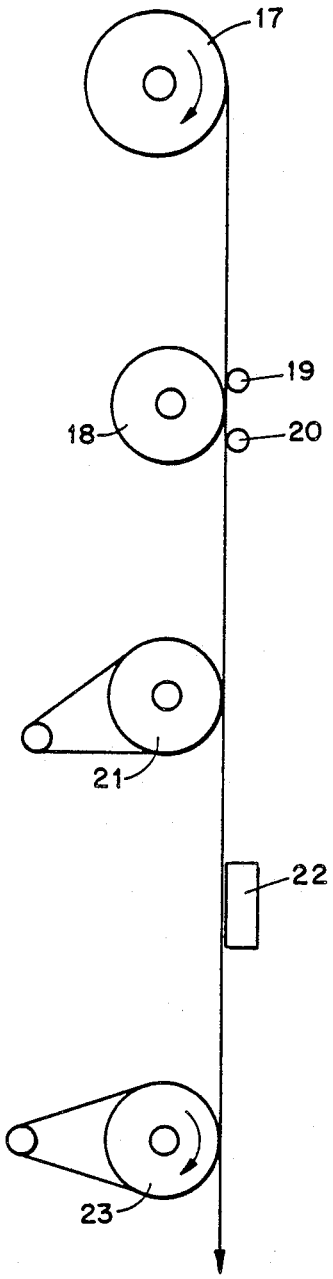
FIG. 2 is a partial schematic of an apparatus and process particularly suitable for the preparation of the polyester yarn having predetermined limits with respect to tenacity and boiling water shrinkage.

Referring to FIG. 2, the feeder yarn is fed continuously from package 17 by feed roll 18 by means of guides 19 and 20. The yarn is taken up and drawn at a point between a first godet 21 and feed roll 18 by means of first godet 21, which is heated. The yarn is drawn at a draw ratio in the range of from about 1.75 to about 2.60, more preferably from about 2.00 to about 2.55, and at ambient temperatures, i.e., 20° to 25° C. Next, substantially sequentially, the yarn is heated (partially annealed) by means of heated godet 21 at a temperature in the range of from about 70° to about 110° C. and, more preferably, 90° to about 110° C. The partially annealed yarn is then pretensioned between godet 21 and godet 23 and heated by means of heater 22 to a temperature in the range of from about 110° to about 60° C. The amount of tension is carefully controlled in order to produce polyester fibers with predetermined boiling water shrinkage and tenacity. A preferred means of imparting tension on yarn during annealing is by overfeeding godet 21 in an amount of from about 0 to about 12% based on the speed of godet 23.

At this point, the yarn is ready to be wound on a pirn (not shown).

The filament yarn produced in accordance with the invention usually has a denier per filament of 1 to 20. Total denier of the yarns produced in accordance with the invention generally range from about 40 to about 200 denier and, preferably, from about 70 to about 150 denier.

The invention is further exemplified by the examples below, which are presented to illustrate certain specific embodiments of the invention, but are not intended to be construed so as to be restrictive of the scope and spirit thereof.

EXAMPLE I

A feeder yarn was prepared which comprised polyethylene terephthalate having a birefringence of 0.034, contained 48 filaments, and had a total denier of 149. The yarn was processed under controlled conditions. The conditions and resulting yarn properties are reported below in Table I.

TABLE I

| Sample | Draw Ratio | Heated Godet Temp. (°C.) | Hot Plate Temp. (°C.) | Tension (grams) | Tenacity (g/den.) | Elongation (%) | Boiling Water Shrinkage (%) |
|---|---|---|---|---|---|---|---|
| A | 2.25 | 84 | 120 | 57.5 | 6.04 | 14.9 | 7.7 |
| B | 2.25 | 84 | 120 | 10.0 | 5.61 | 18.5 | 5.3 |

The results reported in Table I demonstrate the effectiveness of the method of the present invention in producing polyester filaments within predetermined limits of yarn properties including boiling water shrinkage and tenacity. Sample A shows the production of higher tenacity yarns utilizing cold drawing/partial annealing of the feeder yarn and subsequent annealing of the feeder yarn at higher tensions. Sample B shows the preparation of a polyester yarn having a lower tenacity and low boiling water shrinkage yarn by reducing the tension during the annealing of the cold drawn/partially annealed feeder yarn.

EXAMPLE II

Feeder yarns comprising poly(ethylene terephthalate) were prepared and processed under controlled conditions. The feeder yarn characteristics, processing conditions, and resulting yarn properties are reported below in Table II.

TABLE II

| | Feeder Yarn | | | | | | | Results | | |
|---|---|---|---|---|---|---|---|---|---|---|
| Sample | Birefringence | No. of Filaments | Denier | Draw Ratio | Heated Godet Temp. (°C.) | Hot Plate Temp. (°C.) | Tension (grams) | Tenacity (g/den.) | Elongation (%) | Boiling Water Shrinkage (%) |
| C | 0.0357 | 48 | 149 | 2.25 | 90 | 160 | 29.3 | 6.62 | 12.2 | 4.8 |
| D | 0.0356 | 48 | 139 | 2.06 | 90 | 160 | 2.0 | 5.32 | 27.9 | 2.7 |

The results reported in Table II demonstrate the adaptability of the method of the present invention for producing polyester yarns with variable boiling water shrinkages and tenacity. Sample C represents a yarn with higher tenacity and boiling water shrinkage properties. As shown by Sample D, by lowering the draw ratio and tension, lower tenacity and boiling water shrinkage yarns can be produced.

Independently controlling the tension during annealing of a cold drawn partially annealed yarn is an excellent way to produce polyester yarn with predetermined properties.

EXAMPLE III

A feeder yarn having a birefringence of 0.0311 was prepared from poly(ethylene terephthalate) having an intrinsic viscosity of 0.70. The resulting feeder yarn was processed under controlled conditions.

One of the processes was a conventional drawing process utilizing the same equipment as set forth in FIG. 2. During this process, the yarn is only slightly pretensioned between the feed roll and the heated godet. The temperature of the heated godet was necessarily limited to a maximum of 90° C. because the yarn is unoriented and, thus, sticks to the heated godet at higher temperatures. The yarn is drawn between the heated and unheated godets and then passed over the hot plate. Thus, in a conventional process, the yarn is drawn and annealed simultaneously and there is no control of the yarn tension.

In the process of the present invention, the yarn is drawn and then annealed under controlled tension.

The amount of tension utilized in the process was imparted on the yarn by drawing (overfeeding) the yarn between godets which correspond to godet 21 and godet 23 of FIG. 2. The draw ratio is set forth in the bracketed material of the tension column.

The process conditions and the resulting yarn properties are reported below in Table III.

TABLE III

| YARN | DRAW RATIO | HEATED GODET TEMP. (°C.) | HOT PLATE TEMP. (°C.) | TENSION (grams) [draw ratio] | TENACITY (g/denier) | ELONGATION (%) |
|---|---|---|---|---|---|---|
| A (Conventional Process) | 1.009 | 84 | 150 | 148 [2.49] | 7.7 | 7.7 |
| B | 2.49 | 110 | 150 | 43 [0.97] | 7.4 | 9.8 |
| C | 2.49 | 110 | 150 | 11 [0.94] | 7.2 | 12.8 |

As demonstrated by results in Table III, the yarn prepared by the conventional drawing process had very low elongation which the yarn prepared by the present invention had higher elongation. The higher elongation values of the yarn prepared by the present invention allows the yarn to be further processed in subsequent textile processes.

Although certain preferred embodiments of the invention have been described for illustrative purposes, it will be appreciated that various modifications and innovations of the procedures and compositions recited herein may be effected without departure from the basic principles which underlie the invention. Changes of this type are therefore deemed to lie within the spirit and scope of the invention except as may be necessarily limited by the amended claims or reasonable equivalents thereof.

What is claimed is:

1. A process of preparing polyester yarn having predetermined limits with respect to tenacity and boiling water shrinkage comprising:

(a) drawing at ambient temperature a partially oriented feeder yarn comprising polyester filaments having a birefringence of at least 0.0175 at a draw ratio in the range of from about 1.75 to about 260;

(b) partially annealing the drawn feeder yarn of step (a) at a temperature in the range of from about 70° C. to about 110° C., said drawing and said partial annealing occurring substantially sequentially; and, (c) annealing the partially annealed feeder yarn of step (b) at a tension in the range of from about at least 0.001 grams to about 50 grams and at a temperature of from about 110° C. to about 160° C.

2. The process recited in claim 1 wherein said polyester yarn has a tenacity in the range of from about 4.5 to about 7.0 g/denier and a boiling water shrinkage of from about 2 to about 10 percent.

3. The process recited in claim 2 wherein said polyester is a linear terephthalate polyester.

4. The process recited in claim 3 wherein said linear terephthalate polyester is poly(ethylene terephthalate).

5. The process recited in claim 4 wherein said birefringence of said feeder yarn is in the range of from about 0.020 to about 0.037.

6. The process recited in claim 5 wherein the preparation of said feeder yarn comprises:

(i) extruding molten poly(ethylene terephthalate) having an intrinsic viscosity in the range of from about 0.4 to about 0.8 through a spinneret to form one or more filaments;

(ii) quenching said filaments;

(iii) applying an aqueous lubricating finish to said quenched filaments; and, (iv) taking up said filaments at a speed in the range of from about 2,200 to about 3,000 meters per minute.

7. The process recited in claim 6 wherein said fibers are taken up at a speed of about 2,750 meters per minute.

8. The process recited in claim 7 wherein said draw ratio of step (a) is from about 2.00 to about 2.50.

9. The process recited in claim 8 wherein said annealing temperature of step (b) is in the range of from about 90° to about 110° C.

10. The process recited in claim 9 wherein said tension of step (c) is an amount in the range of from about 20 to about 50 grams.

11. The process recited in claim 9 wherein said tension of step (c) is an amount in the range of from about 0.001 to about 10 grams.

12. A process of preparing polyester yarn having a tenacity in the range of from about 6.0 to about 7.5 grams per denier, a boiling water shrinkage in the range of from about 5 to about 10%, and an elongation in the range of from about 12 to about 15%, comprising:

(a) drawing at ambient temperature a partially oriented feeder yarn comprising polyester filaments having a birefringence of at least 0.0175 at a draw ratio in the range of from about 2.20 to about 2.60;

(b) partially annealing the feeder yarn of step (a) at a temperature in the range of from about 90° C. to about 110° C., said drawing and said partial annealing occurring substantially sequentially; and, (c) annealing the partially annealed feeder yarn of step (b) at a tension in the range of from about at least 20 grams to about 50 grams and at a temperature of from about 130° C. to about 160° C.

13. The process recited in claim 12 wherein said polyester is poly(ethylene terephthalate).

14. A process of preparing polyester yarn having a tenacity in the range of from about 4.5 to about 5.5 grams per denier, a boiling water shrinkage in the range of from about 2 to about 3%, and an elongation in the range of from about 25 to about 35% comprising:

(a) drawing at ambient temperature a partially oriented feeder yarn comprising polyester filaments having a birefringence of at least 0.0175 at a draw ratio in the range of from about 1.95 to about 2.05:

(b) partially annealing the drawn feeder yarn of step (a) at a temperature in the range of from about 80° C. to about 100° C., said drawing and said partial annealing occurring substantially sequentially; and, (c) annealing the partially annealed feeder yarn of step (b) at a tension in the range of from about at least 0.001 grams to about 5 grams and at a temperature of from about 140° C. to about 160° C.

15. The process recited in claim 14 wherein said polyester is poly(ethylene terephthalate).

* * * * *

UNITED STATES PATENT AND TRADEMARK OFFICE

CERTIFICATE OF CORRECTION

PATENT NO. : 4,970,038

DATED : November 13, 1990

INVENTOR(S) : Wayne S. Stanko

It is certified that error appears in the above-identified patent and that said Letters Patent is hereby corrected as shown below:

At column 5, line 51, please delete "60°" and insert --160°-- in its place.

At column 7, line 56, please delete "260" and insert --2.60-- in its place.

Signed and Sealed this

Twenty-third Day of February, 1993

*Attest:*

STEPHEN G. KUNIN

*Attesting Officer*

*Acting Commissioner of Patents and Trademarks*